United States Patent [19]

Christian

[11] 4,391,175

[45] Jul. 5, 1983

[54] PERFORATING DEVICE ESPECIALLY ADAPTED FOR USE WITH PRINTING MACHINES

[76] Inventor: Steve Christian, 43, rue Rodin, 93290 Tremblay-les-Gonesse, France

[21] Appl. No.: 247,996

[22] Filed: Mar. 26, 1981

[30] Foreign Application Priority Data

Mar. 27, 1980 [FR] France ..... 80 06862

[51] Int. Cl.[3] ..... B26D 3/00

[52] U.S. Cl. ..... 83/678; 83/651; 83/698

[58] Field of Search ..... 83/651, 665, 678, 698; 76/107 C; 101/30, 116

[56] References Cited

U.S. PATENT DOCUMENTS 2,735,488 2/1956 Anderson et al. ..... 83/678 X 3,147,658 9/1964 Boyd ..... 83/678 X 3,618,438 11/1971 Simson ..... 83/37

*Primary Examiner*—James M. Meister

*Attorney, Agent, or Firm*—Scully, Scott, Murphy & Presser

[57] ABSTRACT

The invention relates to a perforating device or similar cutting means especially adapted for use with printing machines such as those of the offset kind. The perforating device herein comprises a rigid, thin metal plate which presents, in protrusion, on one of its two faces, at least one cutting or perforating element, a layer of adhesive material applied to the side of said thin metal plate opposite said cutting or perforating element, said adhesive layer capable of being protected by a protective strip, and a double faced self-adhesive tape adhering upon one of its faces to the side of said thin metal plate adjacent to said cutting or perforating element, the other face of the double faced self-adhesive tape capable of being protected by a protective strip.

3 Claims, 3 Drawing Figures

PERFORATING DEVICE ESPECIALLY ADAPTED FOR USE WITH PRINTING MACHINES

BACKGROUND OF THE INVENTION

1. Field of the Invention

The present invention relates to a perforating device or similar means especially adapted for use with printing machines such as those of the offset variety as well as the method of operation on said device.

2. Description of the Prior Art

In a general way, a common type of known perforating device used with printing machines consists of a strip, generally metallic, presenting a lateral toothed or sharp raised edge having upon its face opposite the teeth, a layer of adhesive material upon which a protective tape is set which is removed at the moment of use.

A perforating device of this construction is intended to be applied to a pressure cylinder of the printing machine and, more particularly, in the case of an offset machine, on the feeder cylinder pressing the sheets to be printed on the blanket cylinder.

The positioning of the perforating device is then carried out in the following manner:

First, the pressure cylinder is cleaned so as to permit good adhesion of the perforating device thereto.

Next, the text to be printed is transferred upon the pressure cylinder in order to have a guide mark for the proper positioning of the perforating device.

After cutting the perforating device to the length required, the protective tape is removed and the device is adhesively applied to the pressure cylinder at the desired position.

Next, printing trial runs are carried out to determined whether the perforating device is properly positioned and thereafter the final printings are carried out. Of course, in the case where the perforator is not in proper position, whether for having moved during manipulation or else by reason of an error in the positioning operation, the aforedescribed steps must be at least partially repeated.

This procedure is subject to a number of drawbacks:

It is not practical for all printing machines, particularly those in which the pressing or feeding roller is not readily accessible.

Its operation is particularly delicate and is carried out only with difficulty. Thus, the operator must often contort his body in order to succeed in applying the perforating device to the presser roller.

It necessitates a relatively long period of time for being put in operation which is the cause of frequent and prolonged stopping of the printing machine thereby reducing the profit-making capability of the machine and increasing the cost of printed matter.

SUMMARY OF THE INVENTION

The invention has for its purpose the elimination of all the foregoing drawbacks. It proposes to achieve this purpose by providing a perforating device comprising:

(a) a thin, rigid metal plate having the form of a metallic strip, or a plastic material, and which presents in protrusion on one of its two faces at least one cutting or perforating element;

(b) a layer of adhesive material applied to the side of the strip opposite said perforating element, said adhesive capable of being protected by a protective strip which is removed at the moment of use; and (c) a double faced self-adhesive tape adhering on one of its faces to the side of the plate adjacent to said perforating element, the other face of said self-adhesive tape capable of being protected by a protective strip which is removed at the moment of use.

According to another characteristic of the invention, said plate consists in a steel strip presenting a toothed or simply sharp raised edge, which extends perpendicularly to the plane of said strip.

The method for operating the perforating device of the present invention comprises the following operations:

(a) making a lay-out upon a sheet of paper in removing, if it is present, the protective strip from the self-adhesive double faced tape, then in adhesively applying the perforating devices at the back of the sheet at the positions chosen owing to the adhesive face thus removed, with the cutting or perforating elements coming to bear upon the sheet, (b) passing into the printing machine the lay-out thus obtained, after removing, if it is present, the protective strips from the adhesive layer of the different perforating devices so that, during this passing:

the perforating devices come to adhere to the pressing or feeding roller at the positions that they are to occupy, and that the self-adhesive double faced tape is pulled out at the same time as the sheet upon to which is remains adhered, by reason of its adhesive properties on the paper and on the metal.

According to another characteristic of the invention, in order to facilitate the making of said lay-out, the sheet which will then serve to produce the lay-out can be printed beforehand.

BRIEF DESCRIPTION OF THE DRAWINGS

One embodiment of the invention will be described hereafter, as a non-limiting example, referring to the attached drawings in which.

DESCRIPTION OF THE PREFERRED EMBODIMENTS

Figure 1:
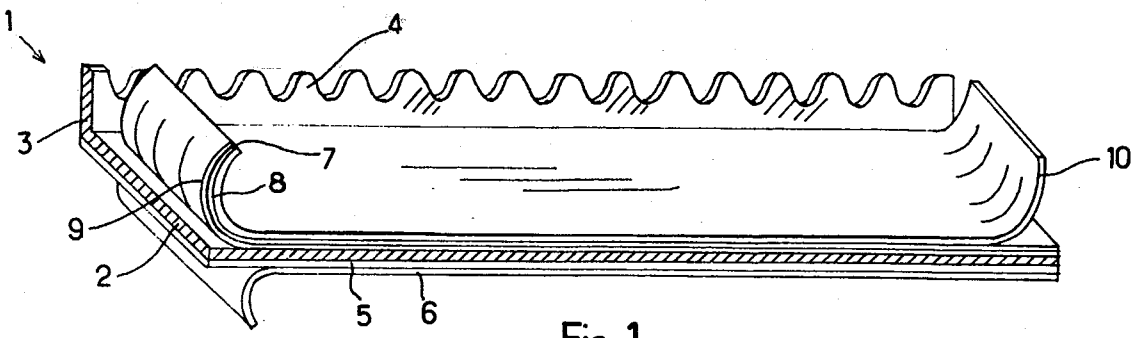
FIG. 1 is a sectional schematic view of a perforating device according to the invention.
Figure 2:
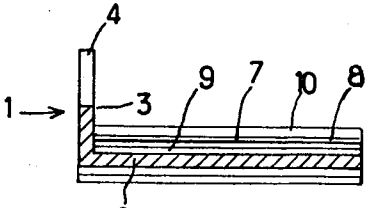
FIG. 2 is a cross-sectional view of the perforating device illustrated in FIG. 1; and, FIG. 3 is a schematic representation of a printing machine of the offset type readily adapted to the use of a perforating device in accordance with the invention herein.

Refering to FIGS. 1 and 2, perforating device 1 comprises a thin plate appearing in the form of a strip 2 of steel having a raised edge 3 at a right angle to the upper part upon which sharp-pointed teeth 4 are provided so as to produce a sharp toothed perforating edge.

As previously mentioned, the lower side of strip 2, opposite the sharp toothed edge, is coated with a layer of adhesive material 5 covered with a protective strip 6 that can be removed with a view to using perforating device 1.

Furthermore, the upper side of strip 2 adjacent to the sharp-toothed edge is covered with a double faced self-adhesive strip, that is, a strip 7 bearing on its two faces an adhesive coating 8 and 9 with adhesive coating 8 which is located on the side opposite steel strip 2 being protected by a protective strip 10 that can be removed at the time of using perforating device 1.

Figure 3:
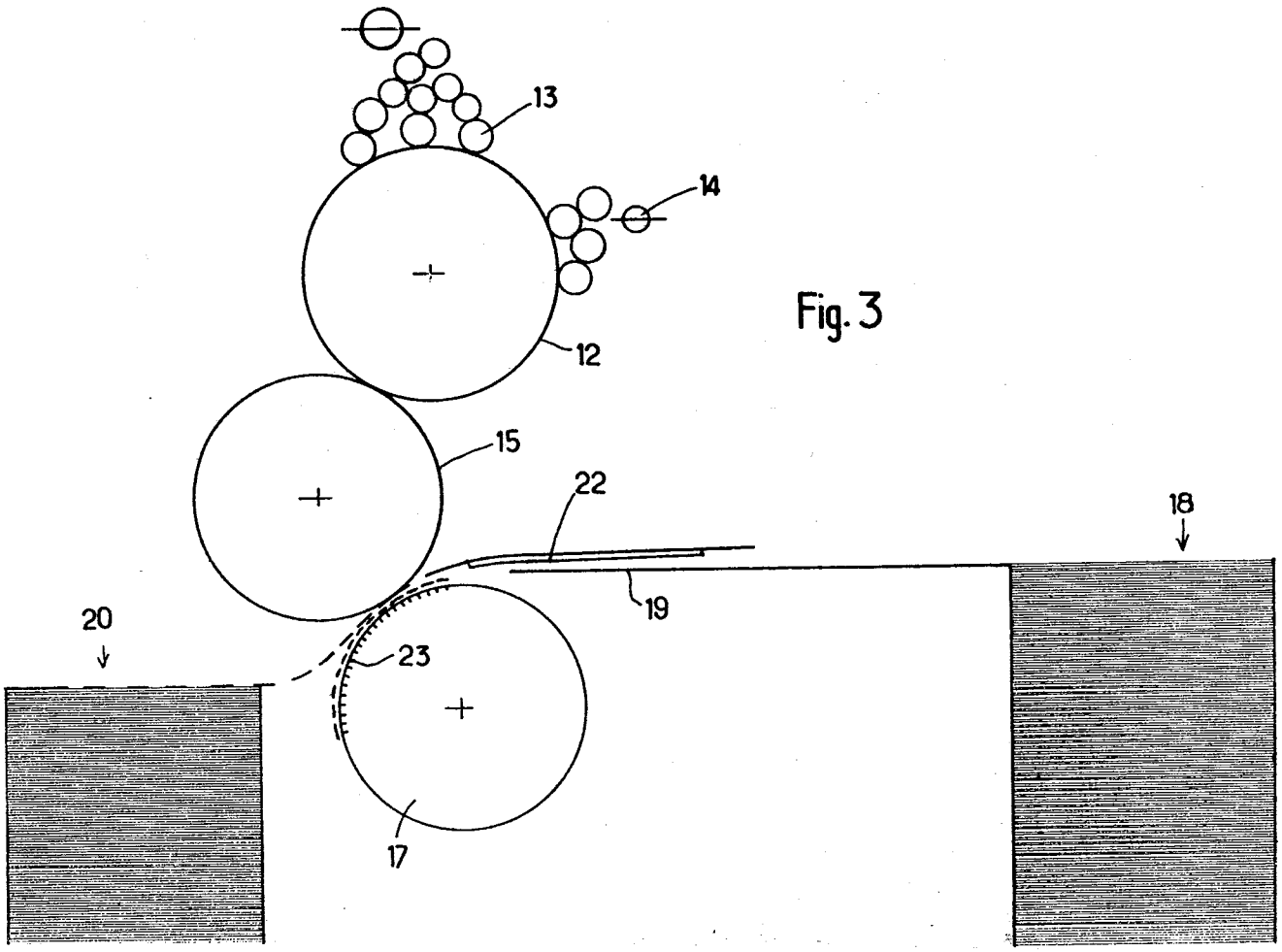

The operation of this perforating device on a printing machine of the offset type will be described hereafter with respect to FIG. 3.

Such a machine comprises, in a standard manner, a plate carrier cylinder 12 provided with inkers 13 and moistening rollers 14, a blanket cylinder 15 and a pressing or feeding cylinder 17.

The blank sheets to be printed are stacked at a supply station 18 and are transferred one by one to a feeder area 19 before passing between blanket cylinder 15 and feeding cylinder 17 where the printing is carried out. The sheets thus printed are thereafter stacked at a receiving station 20. The difficulty of positioning a standard type of perforating device directly on feeder cylinder 17 in the case where the structure of the machine permits it is clearly evident. However, this operation is simplified owing to perforating device 1 which necessitates no manipulation by the operator of feeder cylinder 17.

Therefore, in view of achieving the placement of perforating devices 1 of the type illustrated in FIG. 1 and 2, the operator first proceeds with the printing of a sheet.

After removing protective strips 10, the operator applies the perforating devices on the back of the sheet at the places where the perforations are to be carried out, owing to adhesive face 9 of the strip thus removed, the teeth cutting edge of the steel strip being naturally directed toward the sheet.

Once the perforating devices are placed on the back of the sheet, the operator removes protective strip 6 covering adhesive layer 5 from perforating devices 1 and thereafter makes the sheet thus equipped (sheet 22) pass into the machine, and perforating devices 1 located on feeder cylinder side 17.

During their passage between blanket cylinder 15 and feeding cylinder 17, perforating devices 1 come to adhere automatically to feeder cylinder 17 (perforators in broken lines 23). In a parallel manner, double faced self-adhesive strips 7, 8 and 9 which remain adhered to the sheet become detached from perforating devices 1 (the adherence of double faced self-adhesive strips 7, 8 and 9 on the paper being stronger than their adherence to perforating devices 1).

After the sheet's passage, perforating devices 1 are placed upon feeding cylinder 17 at the proper positions. The operator can now carry out the printing operations with perforation.

Of course, the invention is not limited to the type of perforating device represented in FIGS. 1 and 2. It also relates to all devices of this kind such as groove and cutting devices.

The advantages of perforating devices or a similar means according to the invention clearly appears.

Such devices can be used on all offset-type printing machines, even those which do not allow ready access to the feeding cylinder.

They eliminate all direct manipulation by the operator upon the feeding cylinder and the drawbacks which are attendant such manipulation.

They considerably facilitate the proper positioning of the perforating devices. The task of the operator is reduced to merely placing the perforating devices on a printed sheet capable of being laid out flat on a work table thus making it possible to considerably reduce the time and increase the accuracy of positioning the devices.

They allow an appreciable reduction in the cost of perforated printed matter and enhance the profitability of the printing machines, especially as a result of the labor and time savings obtained.

What is claimed is:

1. Perforating device or similar means, especially adapted for use with printing machines such as offset machines which comprises:

(a) a rigid, thin metallic plate in the form of a strip, which presents, in protrusion, on one of its two faces, at least one cutting or perforating element;

(b) a layer of adhesive material applied upon the side of thin metal plate opposite said cutting or perforating element, said adhesive layer capable of being protected by a protective strip which is removed at the moment of use; and (c) a double faced self-adhesive tape adhering upon one of its faces, upon the side of said thin metal plate adjacent to said cutting or perforating element, the other face of the double faced self-adhesive tape capable of being protected by a protective strip which is removed at the moment of use.

2. Perforating device according to claim 1 wherein said thin metal plate comprises a steel strip having a toothed or sharp raised edge extending perpendicularly to the plane of said strip.

3. The perforating device of claim 1, in which the thin metallic plate is fabricated of steel.

* * * * *